US007988383B2

(12) United States Patent
Hickmann

(10) Patent No.: US 7,988,383 B2
(45) Date of Patent: Aug. 2, 2011

(54) TRANSPORT ATTACHMENT OF A VIBRATION PLATE

(75) Inventor: Kurt Hickmann, Braunshorn (DE)

(73) Assignee: BOMAG GmbH, Boppard (DE)

( * ) Notice: Subject to any disclaimer, the term of this patent is extended or adjusted under 35 U.S.C. 154(b) by 53 days.

(21) Appl. No.: 12/553,822

(22) Filed: Sep. 3, 2009

(65) Prior Publication Data

US 2010/0061803 A1 Mar. 11, 2010

(30) Foreign Application Priority Data

Sep. 3, 2008 (DE) ..... 10 2008 045 557

(51) Int. Cl.
*E01C 19/35* (2006.01)

(52) U.S. Cl. ..... 404/133.1; 404/133.05; 280/47.24

(58) Field of Classification Search .. 404/133.05–133.2; 280/47.24

See application file for complete search history.

(56) References Cited

U.S. PATENT DOCUMENTS

| | | | | |
|---|---|---|---|---|
| 5,439,314 | A * | 8/1995 | Wadensten | 404/133.05 |
| 6,293,729 | B1 * | 9/2001 | Greppmair | 404/133.1 |
| 6,578,858 | B1 | 6/2003 | Haddock | |
| 2006/0083590 | A1 | 4/2006 | Schennach et al. | |
| 2008/0003058 | A1 * | 1/2008 | Persson et al. | 404/133.1 |

FOREIGN PATENT DOCUMENTS

| | | |
|---|---|---|
| DE | 1213353 | 3/1966 |
| DE | 7212695 U | 5/1972 |
| DE | 8416280.5 U1 | 9/1984 |
| EP | 1513985 | 6/2003 |

* cited by examiner

*Primary Examiner* — Raymond W Addie
(74) *Attorney, Agent, or Firm* — Baker & Hostetler LLP

(57) ABSTRACT

A transport attachment of a vibration plate and a vibration plate having transport wheels is provided. The transport wheels are pivotable between a transport position and an operating position, and are located further outward in the viewpoint of the vibration plate in the width direction in the transport position than in the state of the operating position.

15 Claims, 7 Drawing Sheets

TRANSPORT ATTACHMENT OF A VIBRATION PLATE

CROSS-REFERENCE TO RELATED APPLICATIONS

This application claims priority to foreign Patent Application DE 10 2008 045557.1, filed on Sep. 3, 2008, the disclosure of which is incorporated herein by reference in its entirety.

FIELD OF THE INVENTION

The present invention relates to a transport attachment. Specifically, the present invention relates to transport attachment for a vibration plate.

BACKGROUND OF THE INVENTION

Vibration plates or vibration compactors are known from the prior art, which are used, for example, in road construction for ground compaction, etc. Transport carts are known for transporting the vibration plates, which may be hooked in a receptacle of the vibration compactor. Furthermore, transport rollers, which are permanently connected to the vibration plate, are also known.

In the design of a transport attachment, which is attached or attachable directly on the vibration plate, the problem exists on the one hand that the attachment cannot interfere during the normal work using the vibration plate, which means that its transport wheels must have a sufficient distance to the substrate during the work and also may not otherwise obstruct the operability of the vibration plate. Furthermore, the transport wheels must be brought rapidly and easily into the transport position, in which the vibration plate may be transported by rolling.

SUMMARY OF THE INVENTION

Embodiments of the present invention advantageously provide a device for the transportation of a vibration plate, which remedies the cited disadvantages of the prior art, is simple and cost-effective to manufacture, and is as susceptible as little as possible to lateral tilting or falling over. According to embodiments of the present invention, the transport wheels are located far apart from one another in the lateral direction (i.e., the width direction) of the vibration plate, and the transport wheels are situated close to the center of gravity of the vibration plate in the longitudinal direction, in order to better absorb the weight forces better and allow easier movement.

According to various embodiments of the present invention, a transport attachment for a vibration plate is provided, which comprises two transport wheels, which are mounted on a wheel bearing arm so they are each rotatable around one wheel axle of a wheel bearing. Each wheel bearing arm is pivotable in a pivot bearing around one pivot axis in relation to at least one pivot mount. Pivoting is defined as a rotating movement of the wheel bearing arm around the associated pivot bearing. The pivot axes are not parallel to the corresponding wheel axles according to the invention. An angle of at least 5° and at most preferably an angle of at least 20°+/−10° is preferably provided.

The transport attachment is intended to be fastened to a vibration plate so that the pivot axes are oriented diagonally. Diagonally means that the pivot axes do not run along the main lines of symmetry or axes of symmetry of the vibration plate. Through this configuration, during the pivot movement, the corresponding transport wheel does not move along the main planes of symmetry of the vibration plate, but rather a combination of a vertical movement, which brings the transport wheel onto the ground, i.e., into the operating position, and simultaneously a lateral movement from the interior of the vibration plate to a lateral, outer area results. In order to obtain a horizontal orientation of the wheel axles in the operating position, the diagonal configuration of its pivot axis must be compensated for via each wheel bearing arm, which occurs in that the wheel bearing axis is not parallel to the pivot axis. The cited preferred angular ranges result from the structural conditions and in particular the space between the guide brackets.

The transport attachment according to various embodiments of the present invention comprises two separate parts in principle, which are connectable according to embodiments described hereafter using a connection element and/or a shared pivot mount to form a shared assembly.

In an advantageous embodiment, the wheel bearing arms are connected to a connection element, in particular a connection cable or a connection chain. This connection element is capable of absorbing tensile forces and is preferably limp. Through the diagonal configuration of the particular wheel bearing arm on the vibration plate in the transport position, the weight forces of the vibration plate in the transport position cause the wheel bearing arms to spread apart. This is avoided by the tensile forces transmitted in the connection element.

The fastening points of the connection element on the wheel bearing arms are advantageously situated closer to the wheel bearings than to the pivot bearings for this purpose. The distance of the fastening points to the pivot bearings determines the lever arm of the force transmission of the connection element. The greatest possible lever arm is thus preferable to prevent the wheel bearing arms from spreading apart.

The two pivot bearings are preferably fastened to a pivot mount in each case, the pivot mounts being separate components from one another. They each have fasteners for fastening on the vibration plate. An advantage of this embodiment is that each of the wheel bearing arms has a separate fastening and is thus a smaller assembly and is easier to install or remove. In an alternative embodiment, the pivot bearings are connected to a shared, in particular one-piece pivot mount. An advantage of the latter embodiment is that a greater rigidity of the two bearing arms to one another is achieved by the integrated construction.

The pivot mounts advantageously have detent receptacles, which are connectable to latch with corresponding detent elements of the wheel bearing arms in an operating position of the vibration plate. In this way, the wheel bearing arms, when they are folded up into the operating position, may be engaged easily on the frame, or more precisely on the transport attachment. The engagement is a connection capability which is rapid to close and open.

The wheel bearing arms are components which are pivotable separately from one another and in particular independently of one another. This represents a significant difference from known devices, in which the two transport wheels are typically fastened on a frame-like and foldable component. However, the described movement of the wheel bearing arms may not be implemented using a construction of this type.

Furthermore, a vibration plate having a transport attachment as already described is provided according to further embodiments of the present invention. The connection of transport attachment and vibration plate is preferably a screw connection, which represents an easily removable fastening, on the one hand, and a reliable and permanent fastening, on the other hand.

Furthermore, according to various embodiments of the present invention, a vibration plate having transport wheels is provided, which are each pivotable between a transport position and an operating position. The transport wheels are located for this purpose in the transport position further out of view of the vibration plate in the width direction than in the state of the operating position. The width direction is the direction in which the user looks when he stands behind the guide bracket of the vibration plate and operates the vibration plate as it functions. The width direction may also be defined as the direction of the wheel axles when the transport wheels are located in the transport position. Because the transport wheels are offset outward, the stability against possible lateral tipping of the vibration plate during transport increases.

Preferably, the transport wheels are located at least partially or even completely outside the vibration plate in the width direction in the transport position, whereby the susceptibility to tilting is correspondingly reduced.

The orientation of the wheel axles advantageously also changes when pivoting between the transport position and the operating position. The location/orientation of the wheel axles is defined relative to the vibration plate for this purpose. For rolling, i.e., in the transport position, the wheel axles must be oriented parallel to the substrate. In contrast, in the operating position, they are to be situated on the vibration plate in such a way that they interfere as little as possible. This is achieved in that not only their location, but rather also their angle changes upon pivoting.

In an advantageous embodiment, the wheel bearings are located below the base plate of the vibration plate and, furthermore, the wheel bearing arms comprise legs to support the vibration plate against the wheel bearing arms. This comprises two possible embodiments. On the one hand, both the wheel bearings and also the transport wheels may be located below the base plate, so that the legs (and/or the support) must have a specific length as spacers from the wheel bearing arm to the base plate, in order to ensure the free mobility of the transport wheels. On the other hand, only the wheel bearings may lie below the base and the transport wheels may be situated laterally offset adjacent to the base plate. In this case, the legs are only required as a support of the wheel bearing arms to the base plate for the purpose of absorbing the weight forces of the vibration plate. However, in this case the legs have no spacer function. "Below" only relates to the vertical orientation here and also comprises the wheel bearings being able to lie outside the area of the base plate in the lateral direction.

Furthermore, in addition to the cited mounting of the wheel bearing arms, further guide elements are provided for the wheel bearing arms which delimit the mobility of the wheel bearing arms in the transport position outward in the width direction of the vibration plate. Because the wheel bearing arms are oriented diagonally, i.e., at an angle to the vertical, in the transport position, the weight forces cause spreading out of their lower ends. The further guide means which prevent this may be a connection cable or chain, or depressions or guide areas shaped onto the vibration plate or in particular its base plate, which are in contact with the legs or other functional areas of the wheel bearing arms and prevent or delimit spreading apart.

The pivot bearings are preferably inclined in relation to the horizontal around angles such that they cancel out the angles between the wheel axle and the pivot axis in such a way that the wheel axles are oriented essentially horizontally in the transport position.

In a refined embodiment, a locking mechanism is provided for fixing the guide bracket of the manual movement of the vibration plate against pivoting around a rotation point located on the vibration plate. The guide bracket is the bracket, using which the operator, when he stands behind the vibration plate, pulls, pushes, or guides the vibration plate over the surface to be flattened/compacted. Fixing or locking the guide bracket is necessary in order to be able to lift the vibration plate easily, on the one hand, in order to be able to bring the transport wheels below the vibration plate into the transport position, and, on the other hand, to be able to propel the vibration plate by rolling.

In particular, this locking mechanism is implemented as a lever or bolt, which is fastened on the vibration plate or the attachment part and engages against a corresponding functional surface of the guide bracket. Alternatively, the lever or bolt may also be fastened on the guide bracket and engage against a corresponding functional surface of the vibration plate or the transport attachment. The lever or bolt is especially preferably situated on the transport attachment. This is advisable if the transport attachment is offered as an optional accessory part for the vibration plate. Specifically, because a locking of the guide bracket is necessary in particular only for the case that a transport attachment is attached, this mechanism is also to be provided on the transport attachment and/or delivered with it for reasons of efficiency.

BRIEF DESCRIPTION OF THE DRAWINGS

Embodiments of the present invention are shown in the following figures and explained in greater detail hereafter. In the figures.

DETAILED DESCRIPTION

Figure 1:
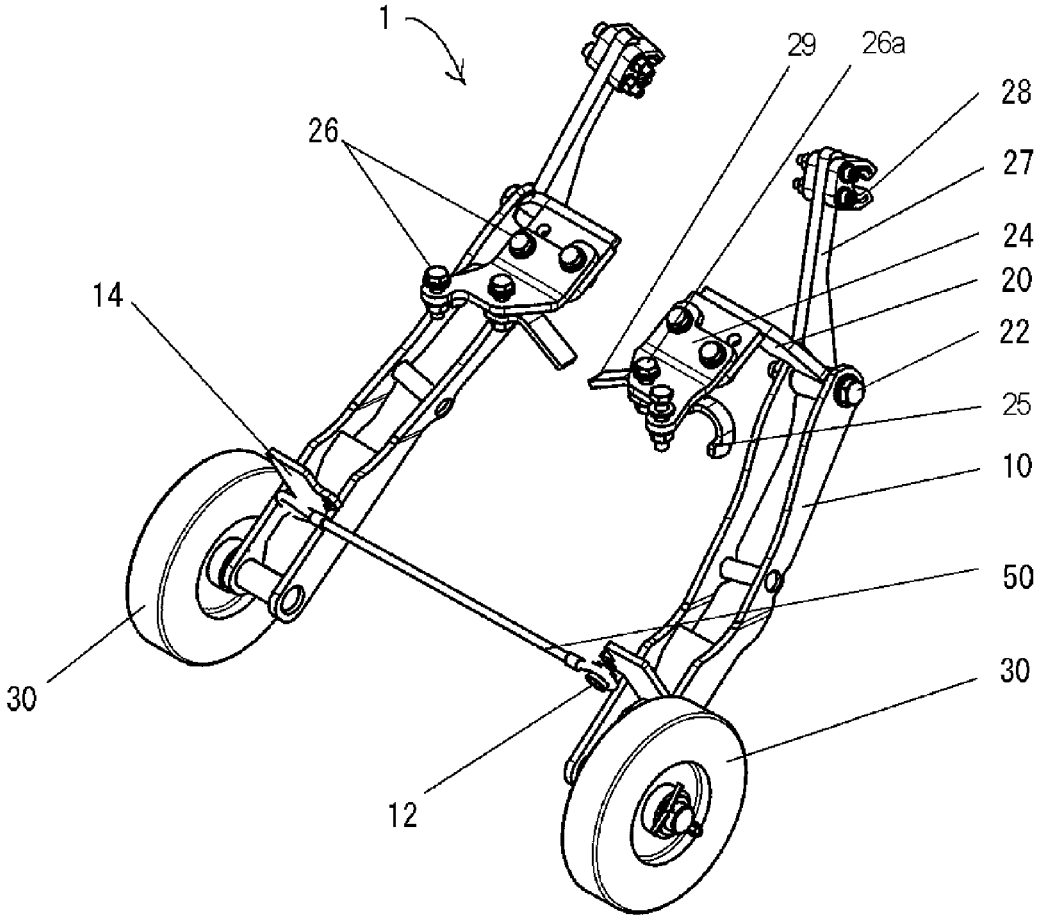
FIG. 1 shows a three-dimensional view of the transport attachment in the transport position, the vibration plate connected thereto not being shown, according to an embodiment of the present invention.

Embodiments of the present invention provide a transport attachment. FIG. 1 shows a transport attachment 1 without the associated vibration plate in the transport position. The transport attachment essentially comprises two halves, which are implemented as mirror-symmetric to one another. The following description essentially explains only one half in each case, the other half being constructed correspondingly and also being intended. In this meaning, each of these halves comprises one transport wheel 30, which is mounted so it is rotatable in relation to the wheel bearing arm 10 in the wheel bearing 32. The wheel bearing arm 10 is mounted so it is pivotable in the pivot bearing 22 in relation to the pivot mount 20. The pivot mount 20 is screwed to a fastener 24, which is in turn connected to a corresponding area (not shown) of the vibration plate 70. The wheel bearing arm 10 is thus pivotable in relation to the vibration plate 70. Furthermore, a detent arm 27, which is provided with a detent receptacle 28, is shaped on the pivot mount 20.

The detent receptacle 28 is U-shaped and has its base fastened on the detent arm 27, in particular screwed on. The two flanks of the "U" have indentations oriented toward one another on their ends. The wheel bearing arm 10 has a detent element 18, which is implemented as a cylindrical pin. If the wheel bearing arm 10 is pivoted toward the detent arm 27, the detent element 18 comes into contact with the flanks of the "U". Because the flanks are implemented as spring-elastic, the flanks widen elastically and the detent element slides along the indentations to the base of the "U". The wheel bearing arm 10 is now located in the operating position. The operating position is the location of the transport attachment and in particular its wheel bearing arm 10 in which the vibration plate 70 may operate in its function. The detent receptacle 70 is preferably implemented from an elastic material such as hard rubber, metal-reinforced rubber, spring steel, or rubber-coated spring steel. Alternatively, a corresponding springy element may also be fastened on the wheel bearing arm 10 and may be able to be engaged with a rigid element of either a detent arm or the vibration plate 70.

Because both weight forces and also bending and torsion torques load the bearing arm 10, it is implemented as sufficiently stable. This is implemented by two oblong steel plates, situated essentially parallel, which are connected to one another on the one hand via the detent element 18 and a further interposed steel plate. Furthermore, at one end of the wheel bearing arm 10, the spacing of the steel plates defines the length of the pivot bearing 22 and at the other end the two steel plates are connected via a wheel bearing pin of the wheel bearing 32.

Figure 2:
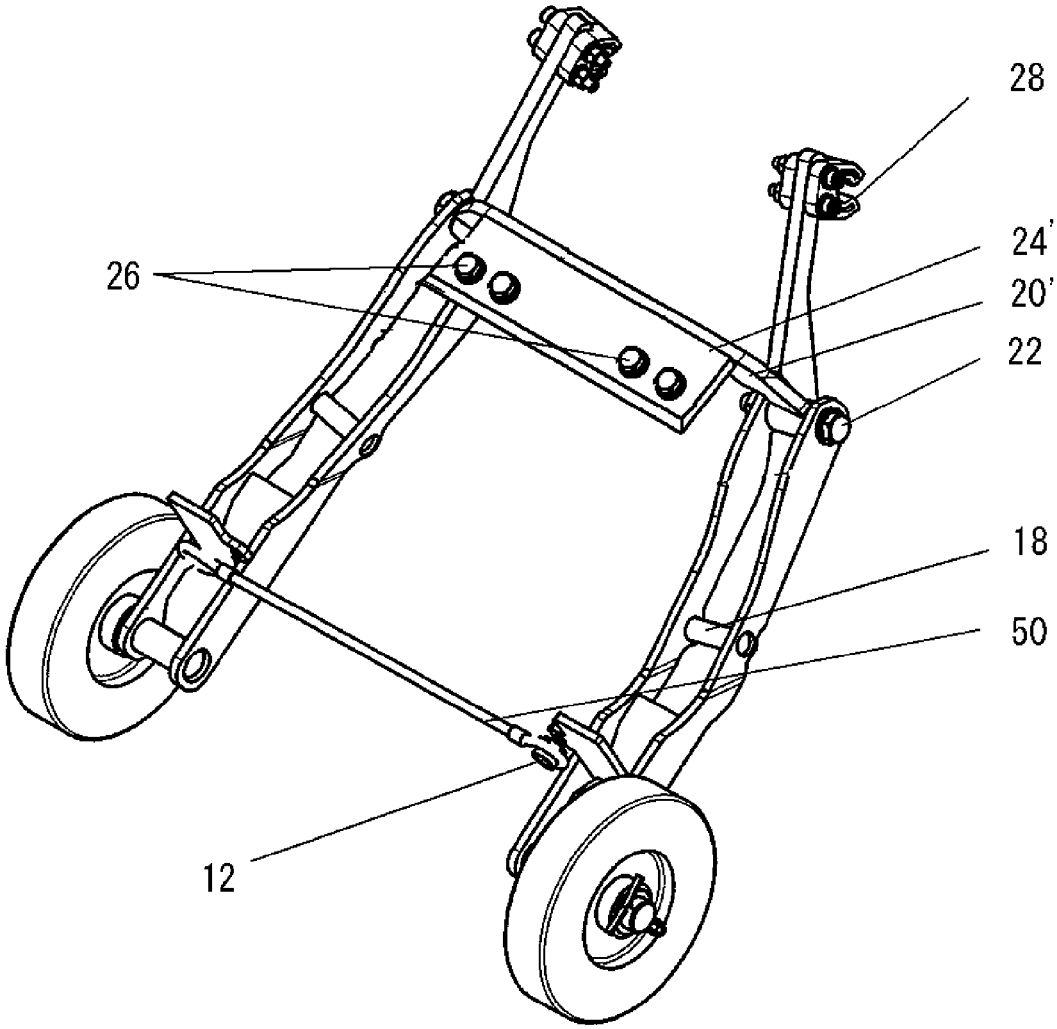
FIG. 2 shows a three-dimensional view of a variant of the transport attachment, also in the transport position and without vibration plate, according to an embodiment of the present invention.

FIG. 2 shows an alternative embodiment, in which the pivot bearings 22 of both wheel bearing arms 30 are connected via a joint pivot mount 20'. The pivot mount 20' can be connected correspondingly using fastener 24', which is implemented here as an oblong profile, to the vibration plate 70. In this embodiment, both wheel bearing arms form a unit with the pivot mount.

Figure 3:
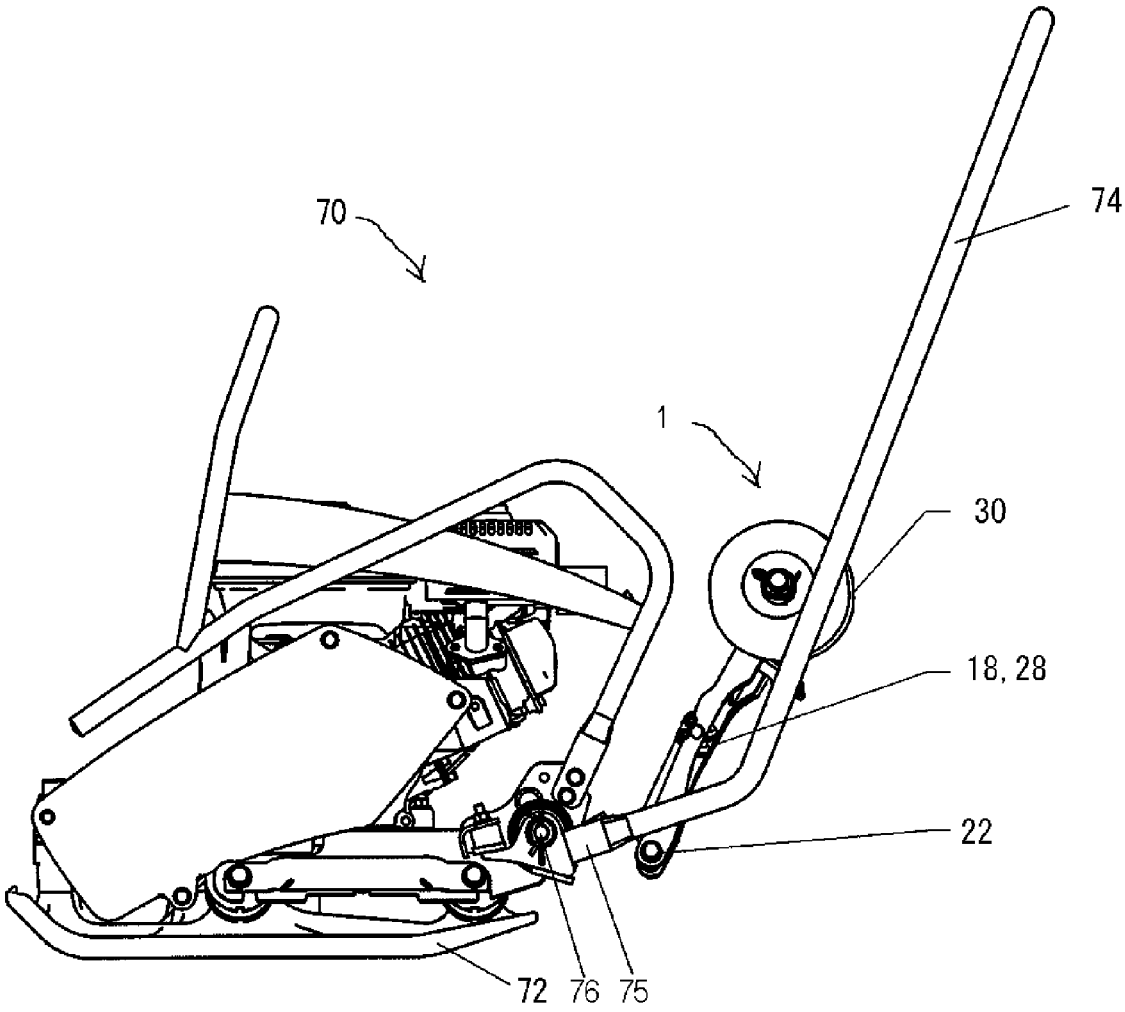
FIG. 3 shows a side view of the vibration plate having the transport attachment in the operating position, according to an embodiment of the present invention.

FIG. 3 shows a side view of the vibration plate in its operating position with transport attachment 1 connected thereto, which is located in the rest position. This means that the transport wheels 30 are folded up by their pivoting around the pivot bearing 22, so that they have no ground contact and do not obstruct the ground compaction of the vibration plate.

Figure 4:
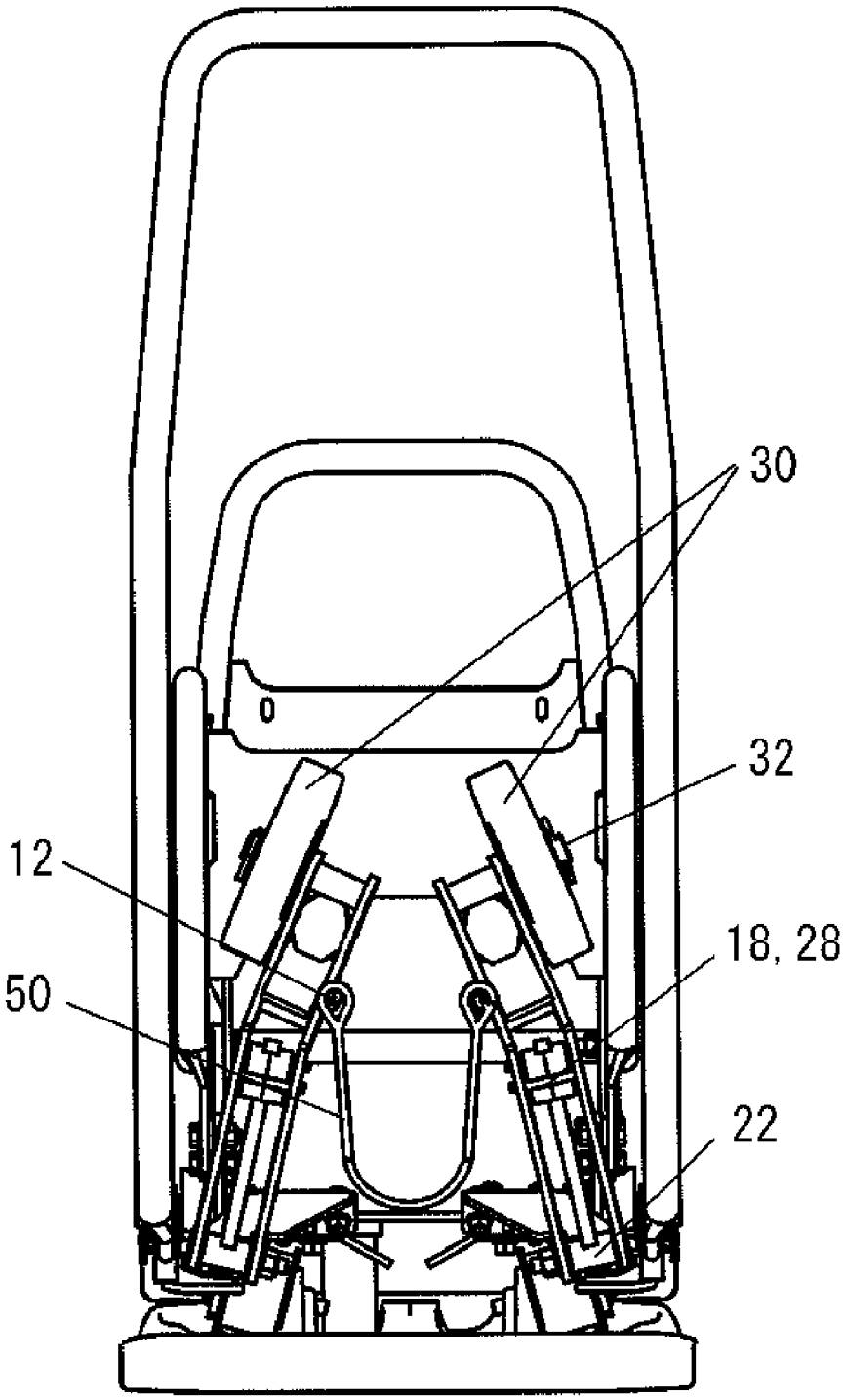
FIG. 4 shows a rear view of the vibration plate in the operating position, according to an embodiment of the present invention.
Figure 5:
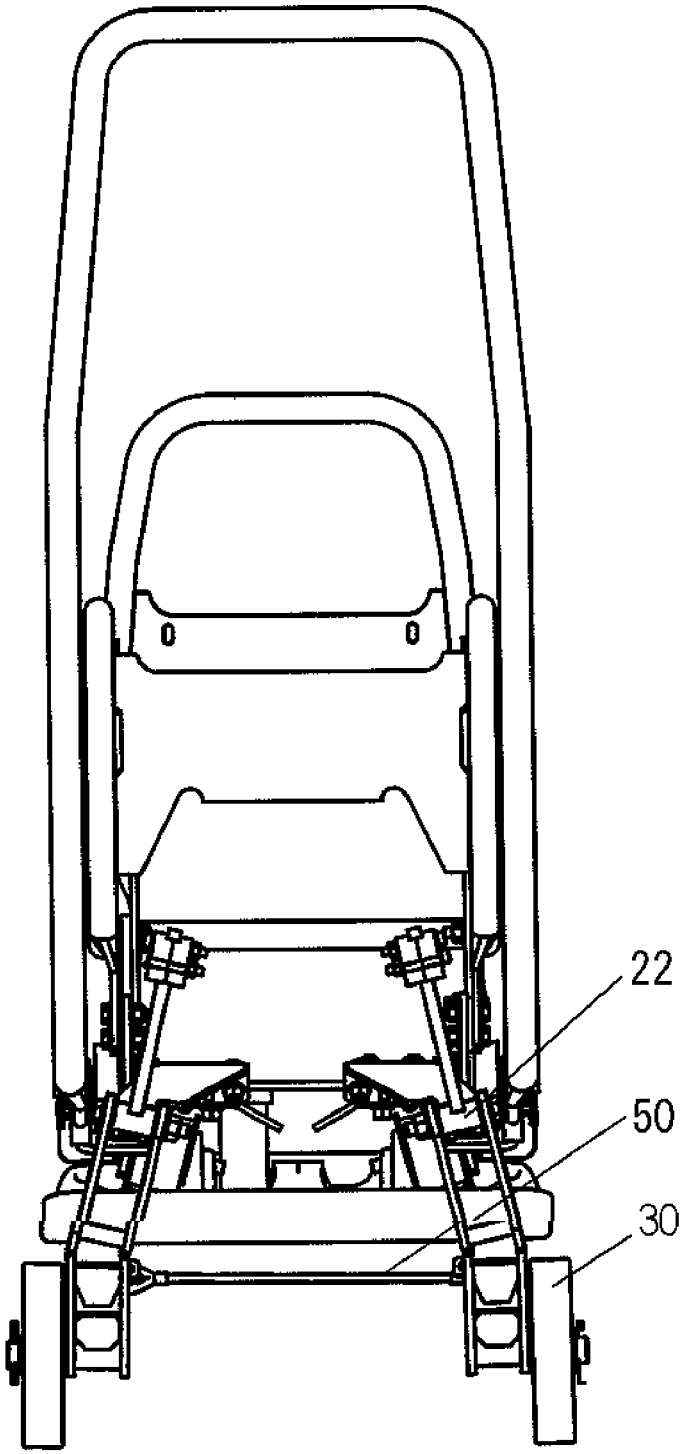
FIG. 5 shows a rear view of the vibration plate in the transport position, according to an embodiment of the present invention.

FIG. 4 shows a rear view of the vibration plate and corresponds to FIG. 3 in viewing direction from its right side. The pivot bearings 22 have an inclination of approximately 15° in relation to the horizontal. Furthermore, it is obvious that the wheel axles of the wheel bearings 32 and the pivot axes of the pivot bearings 22 are situated at a wider angle. If, as shown in FIG. 5, the transport attachment is folded into the transport position, i.e., both transport wheels 30 have ground contact, the above-mentioned two angles supplement one another in this location in such a way that the wheel axles are oriented horizontally. If the wheel axles were not oriented horizontally in the transport position, the weight forces would also cause further, undesired various other axial forces or tilting torques in the wheel bearings. The pivot bearings 22 are situated in such a way that the spacing of the transport wheels 30 in the transport position is greater than in the idle position. In this way, it is possible that the transport wheels come to rest in their idle position between the vertical spars of the guide bracket (74) and may be removably fastened on the spars.

The vibration plate and the transport attachment are illustrated in the transport position in FIG. 5. It shows the connection cable 50, which is symmetrically fastened on both wheel bearing arms 10 and which is stretched in the transport position shown. Because the contact of the transport wheels 30 is significantly further out and/or on the lateral edges of the vibration plate 70 than the pivot bearings 22, bending torques occur, which press the wheel bearing arms 10 having the transport wheels 30 further outward. This movement is delimited by the connection cable 50. This connection cable is shown relaxed in FIG. 4 and hanging in a U-shape between the fastening pins 12. The ends of the connection cable 50 are implemented as loops through which the fastening pins 12 engage and are implemented with play so that the loops may be oriented by the location. The loops are prevented from slipping off of the fastening pins by a head-shaped bulge of the fastening pins 12.

Figure 6:
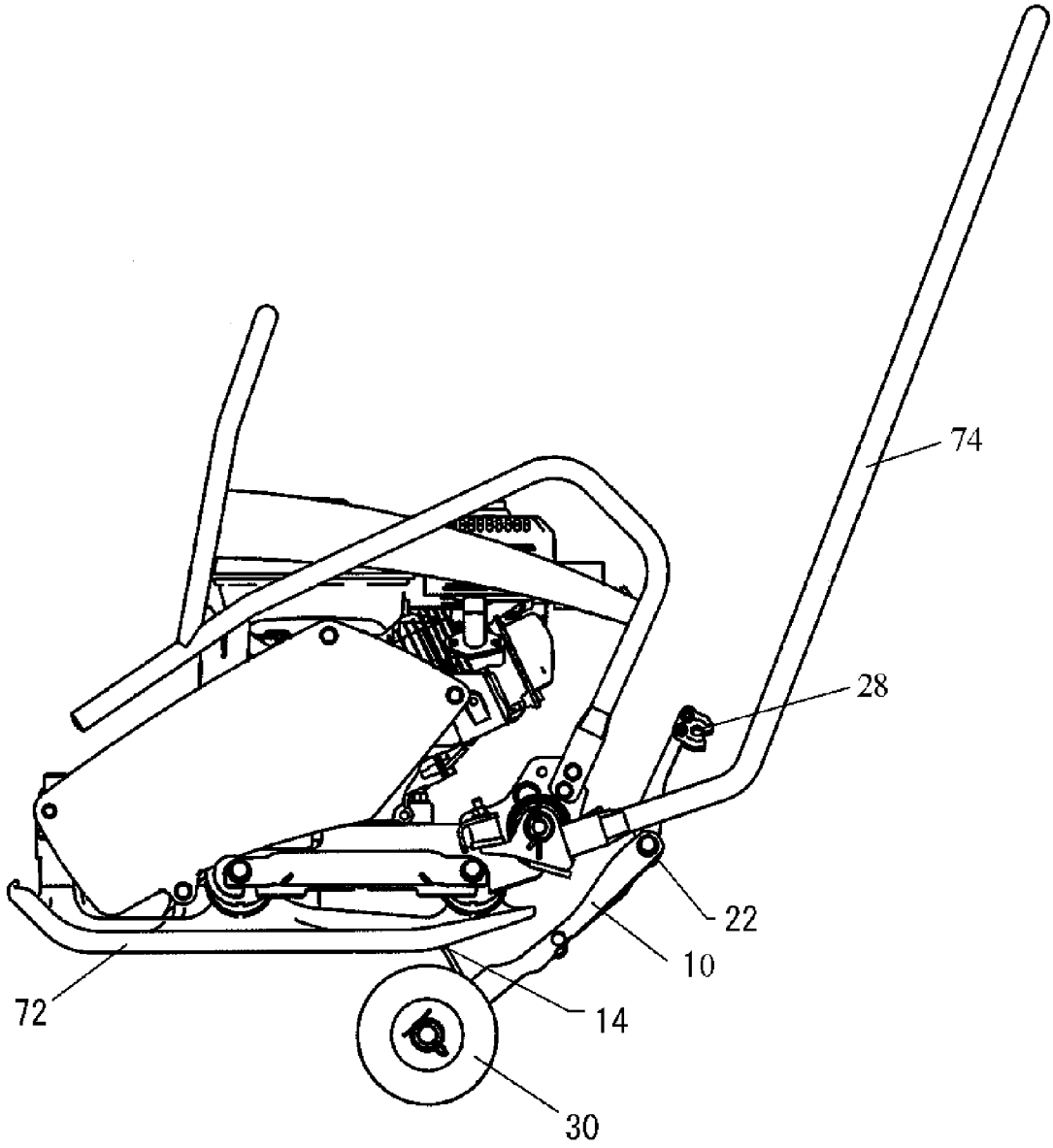
FIG. 6 shows a side view of the vibration plate in the transport position, according to an embodiment of the present invention.

FIG. 6 shows in a side view how the legs 14, which are each shaped onto the wheel bearing arms 10, are engaged in the transport position with the base plate 72 of the vibration plate 70. The length of the leg is selected so that its terminal front face supports the wheel bearing arm 10 against the base plate 72. In this way, a sufficient spacing of the transport wheels 30 to the base plate 72 is implemented, so that the wheels may rotate freely.

Figure 7:
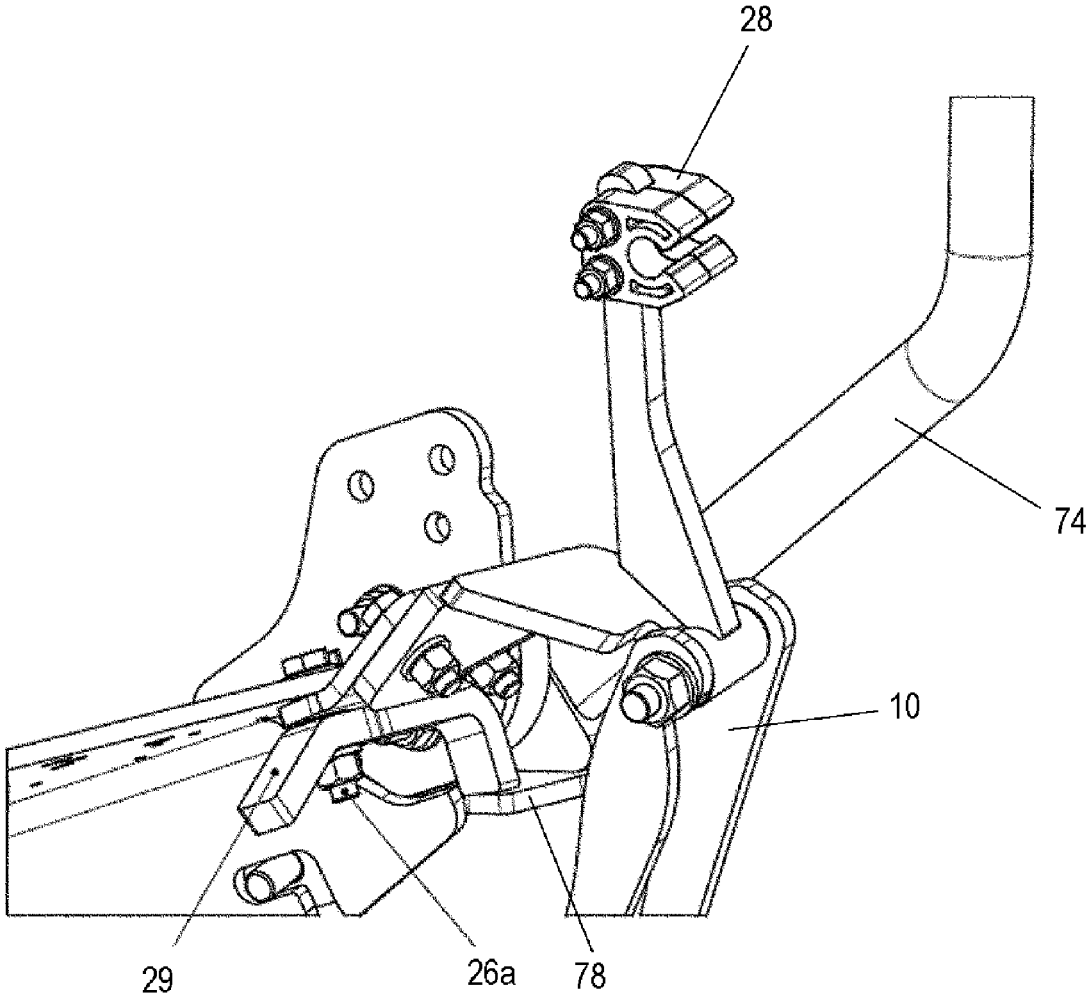
FIG. 7 shows an illustration of the locking mechanism of the guide bracket, the right locking mechanism from the viewpoint of the vibration plate user being shown, according to an embodiment of the present invention.

Furthermore, according to FIG. 7 the fastening means 24 comprise a guide bracket locking lever 25 having a handle 29. This lever is mounted so it is pivotable around the screw connection **26*a*, which is adjacent to the handle 29. A semicircular geometry having a short elongation pointing downward is shaped onto the end of the guide bracket locking lever 25 which is distant from the handle 29. The front face of this elongation pointing downward is the active face of the guide bracket locking lever 25. An essentially horizontally implemented plate-shaped or web-shaped contact surface 78 which points toward the interior of the guide bracket 74 is shaped onto the guide bracket sleeve 75 of the guide bracket 74 shown in FIG. 3. The above-mentioned active face can be engaged with the top side of the cited contact face, whereby the mobility of the guide bracket 74 upward around its point of rotation 76 is delimited. Because the mobility of the guide bracket 74 is delimited downward by further limiting means (not shown), its pivotability is effectively prevented by engagement of the guide bracket locking lever 25, so that the vibration plate may be raised and moved by pressing down the upper end of the guide bracket 74**.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A transport attachment for a vibration plate, comprising:

two wheel bearing arms, each including a transport wheel; and at least one pivot mount including two pivot bearings, each attached to one of the wheel bearing arms, wherein the transport wheels are pivotable between a pivoted-out transport position and a pivoted-in idle position, and wherein the pivot axes of the pivot bearings are diagonally-oriented such that the spacing of the transport wheels is greater in the transport position than in the idle position.

2. The transport attachment according to claim 1, wherein the wheel bearing arms are connected using a connection element, the connection element including a limp connection element, a connection cable or a connection chain.

3. The transport attachment according to claim 2, wherein the connection element includes fastening points that are disposed closer to the wheel bearings than the pivot bearings.

4. The transport attachment according to claim 1, wherein the two pivot bearings are fastened on respective pivot mounts, and wherein each pivot mount has fasteners for fastening on the vibration plate.

5. The transport attachment according to claim 1, wherein the pivot bearings are connected to a shared pivot mount and the pivot mount has fasteners for fastening on the vibration plate.

6. The transport attachment according to claim 4, wherein the pivot mount has detent receptacles that latch with corresponding detent elements of the wheel bearing arms in an operating position of the vibration plate.

7. The transport attachment according to claim 1, wherein the wheel bearing arms are separate components that are independently pivotable.

8. A vibration plate including a guide bracket and a transport attachment according to claim 1, wherein the transport wheels come to rest between vertical spars of the guide bracket in the idle position, and the wheel bearing arms are each removably held on at least one of the spars in the idle position using a detent closure.

9. The vibration plate according to claim 8, wherein the transport wheels are pivotable between the transport and operating positions so that, upon pivoting, the orientation of the wheel axles changes relative to the vibration plate.

10. The vibration plate according to claim 8, wherein, in the transport position, the wheel axles of the transport wheels are oriented essentially axially-parallel along the width direction of the vibration plate in the transport position.

11. A vibration plate according to claim 8, wherein, in the transport position, the wheel bearings are below the bottom side of a base plate of the vibration plate.

12. The vibration plate according to claim 8, wherein, the wheel bearing arms include guide elements which, in the transport position, delimit the outward mobility of the wheel bearing arms in the width direction of the vibration plate.

13. The vibration plate according to claim 8, further comprising a connection element, fasted to the wheel bearing arms, to transmit tensile forces in the transport position.

14. The vibration plate according to claim 8, further comprising a locking mechanism to fix a guide bracket of the vibration plate against pivoting around a rotation point located on the vibration plate, wherein the locking mechanism comprises a locking element, including a lever or a bolt, which is movable on the transport attachment.

15. The vibration plate according to claim 8, wherein each wheel bearing arm includes a leg to support the vibration plate.

* * * * *